US011441840B2

(12) United States Patent
Briglia et al.

(10) Patent No.: US 11,441,840 B2
(45) Date of Patent: Sep. 13, 2022

(54) PROCESS AND PLANT FOR THE PRODUCTION OF ARGON BY CRYOGENIC DISTILLATION OF AIR

(71) Applicant: L'Air Liquide, Societe Anonyme pour l'Etude et l'Exploitation des Procedes Georges Claude, Paris (FR)

(72) Inventors: Alain Briglia, Hangzhou (CN); Frederic Staine, Champigny sur Marne (FR); Mathieu Leaute, Le Plessis Robinson (FR); Ingrid Berthaume, Paris (FR); Benedicte Dos Santos, Champigny sur Marne (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 429 days.

(21) Appl. No.: 16/527,467

(22) Filed: Jul. 31, 2019

(65) Prior Publication Data

US 2020/0041204 A1 Feb. 6, 2020

(30) Foreign Application Priority Data

Aug. 1, 2018 (FR) ..... 1857220

(51) Int. Cl.
*F25J 3/04* (2006.01)

(52) U.S. Cl.
CPC ..... *F25J 3/048* (2013.01); *F25J 3/04721* (2013.01); *F25J 3/04842* (2013.01);
(Continued)

(58) Field of Classification Search
CPC .... F25J 3/0285; F25J 3/04648; F25J 3/04654; F25J 3/0466; F25J 3/04666;
(Continued)

(56) References Cited

U.S. PATENT DOCUMENTS 3,878,689 A * 4/1975 Grenci ..... F25J 1/0275 62/614
4,695,303 A 9/1987 Montgomery et al.
2017/0211882 A1* 7/2017 Alekseev ..... F25J 3/04024

FOREIGN PATENT DOCUMENTS

DE 195 07 981 9/1995
JP H10 54656 2/1998
(Continued)

OTHER PUBLICATIONS

EP Search Report and Written Opinion for EP 19187493.2, dated Nov. 21, 2019. (Machine Translation).
(Continued)

*Primary Examiner* — Brian M King
*Assistant Examiner* — Erik Mendoza-Wilkenfel
(74) *Attorney, Agent, or Firm* — Justin K. Murray

(57) ABSTRACT

Plant for the production of argon by cryogenic distillation, comprising an argon separation column, means for sending a gas containing argon and oxygen to the argon separation column, means for extracting a fluid enriched in argon at the top of the argon separation column, means for extracting a liquid enriched in oxygen at the bottom of the argon separation column and at least two storage tanks, positioned one above the other, each storage tank being connected to two different intermediate levels of the argon separation column by two pipes, the two storage tanks being contiguous.

15 Claims, 1 Drawing Sheet

(52) U.S. Cl.
CPC ..... *F25J 3/04878* (2013.01); *F25J 3/04927* (2013.01); *F25J 2290/62* (2013.01)

(58) Field of Classification Search
CPC .. F25J 3/04672; F25J 3/04678; F25J 3/04684; F25J 3/0469; F25J 3/04696; F25J 3/04703; F25J 3/04709; F25J 3/04715; F25J 3/04721; F25J 3/04727; F25J 3/04733; F25J 3/04739; F25J 3/00; F25J 3/02; F25J 3/04; F25J 3/048; F25J 3/04806; F25J 3/04496; F25J 2290/62; F25J 3/04763; F25J 3/04769; F25J 3/04812; F25J 3/04818; F25J 3/04824; F25J 3/0483; F25J 3/04836; F25J 3/04842; F25J 3/04848; F25J 3/04933
See application file for complete search history.

(56) References Cited

FOREIGN PATENT DOCUMENTS

| | | | |
|---|---|---|---|
| JP | H11 270965 | | 10/1999 |
| JP | H11270965 A | * | 10/1999 |

OTHER PUBLICATIONS

French Search Report and Written Opinion for FR1857220, dated May 20, 2019 (Machine Translation).
"Start-Up Storage Means for Off-Spec Argon in an Air Separation Unit," Disclosed Anonymously, Research Disclosure, Kenneth Mason Publications, No. 433, May 1, 2000, p. 824.

* cited by examiner

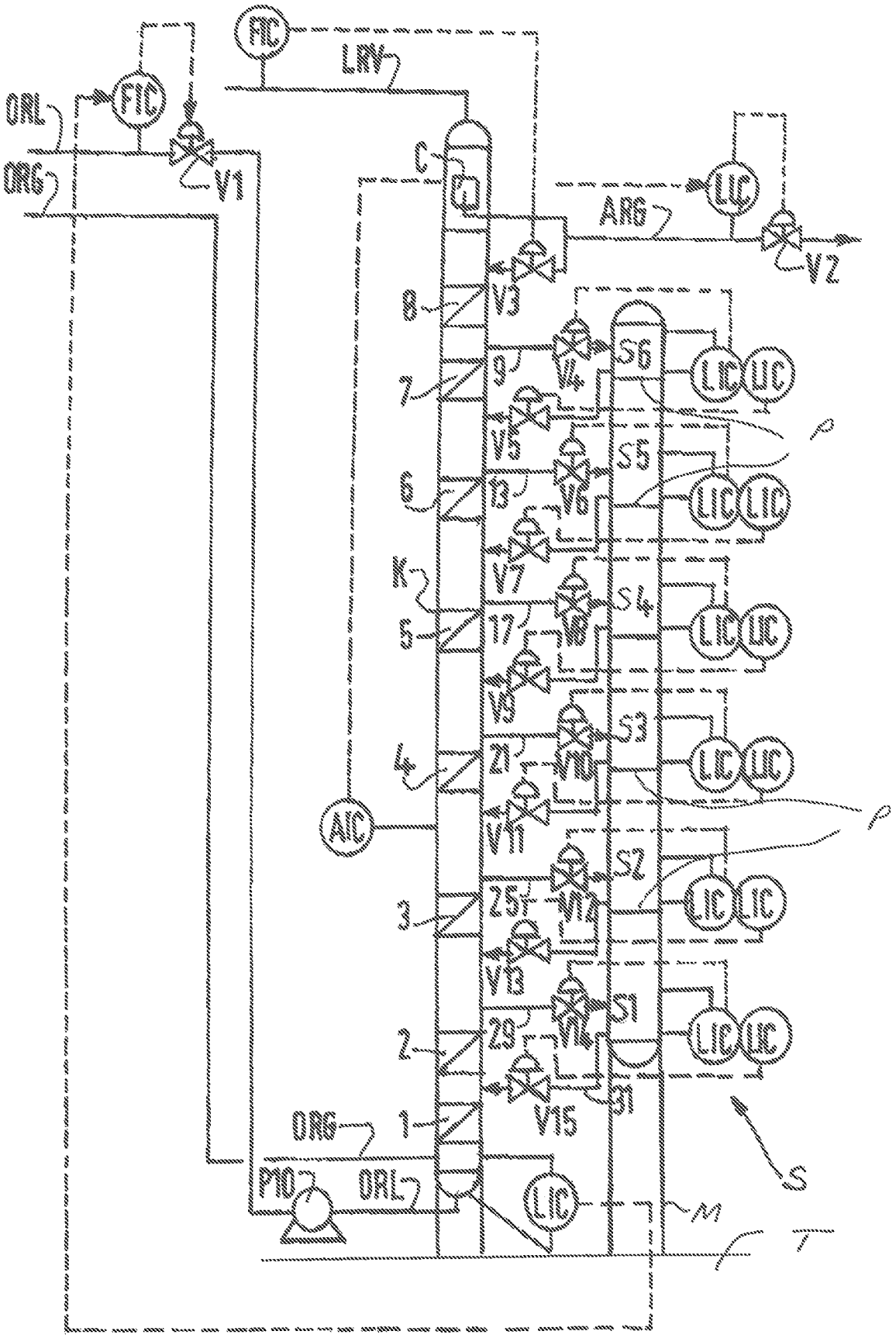
FIC
LRV
ORL
ORG
V1
C
ARG
LIC
V2
V3
8
9
7
V4
S6
V5
S5
6
13
V6
K
V7
S4
5
17
V8
V9
S3
4
21
V10
AIC
V11
S2
3
25
V12
V13
S1
2
29
V14
V15
31
1
ORG
P10
ORL
M
T
S

PROCESS AND PLANT FOR THE PRODUCTION OF ARGON BY CRYOGENIC DISTILLATION OF AIR

CROSS REFERENCE TO RELATED APPLICATIONS

This application claims the benefit of priority under 35 U.S.C. § 119 (a) and (b) to French patent application No. FR1857220, filed Aug. 1, 2018, the entire contents of which is incorporated herein by reference.

FIELD OF THE INVENTION

The present invention relates to a process and to a plant for the production of argon by cryogenic distillation of a gas from air.

BACKGROUND OF THE INVENTION

Air separation units comprising an argon separation column generally have several operating points and a certain operating range.

It is common to pass from one operating point to another at rates of approximately 0.5%/min without addition of supplementary items of equipment. The problem to be solved is that of finding a solution which makes it possible to retain the unvarying L/V ratios during the change-overs of the argon column so as to be able to increase the change-over rate, while maintaining yields close to the nominal case.

The invention consists in installing intermediate vessels at the outlet of the distributors which are filled with the excess liquid during the fall in load and are used during the rise in load as, without these vessels, the column would be in deficit of liquid and thus of reflux.

The notable advantage of this invention makes it possible to modify the load of the production of argon in the rise and in the fall as quickly as the productions of oxygen and of nitrogen and to achieve expected rates which can range up to 5%/min or possibly beyond, depending on the size of the plant and on the volumes to be deployed.

It is known, from "Start-up storage means for off-spec argon in an air separation unit", Research Disclosures, May 2000, to store a liquid originating from an air separation column in a storage tank during the shutdown of the column and to return it to the column on starting up again.

SUMMARY OF THE INVENTION

According to a subject-matter of this invention, provision is made for a process for the production of argon by cryogenic distillation in which a gas enriched in argon (ORG) produced by air separation is sent to an argon separation column (K), a flow rich in argon (ARG) is withdrawn at the top of the column and a liquid enriched in oxygen (ORL) is withdrawn at the bottom of the column and returned to the system of columns, in which:

i) during a first operation, if, preferably only if, the load of the column is below a first threshold, liquid is withdrawn from the column at a first intermediate level of the column and stored in a first storage tank, no liquid being sent from the storage tank to the column, ii) during a second operation, if, preferably only if, the load of the column is above a second threshold, greater than the first threshold, no liquid is sent from the column to the first storage tank, liquid is sent from the first storage tank to the column at a second intermediate level of the column separated from the first intermediate level by at least one layer of elements making possible the exchange of mass and of heat, the second intermediate level being located below the first intermediate level.

According to a subject-matter of the invention, provision is made for a process for the production of argon by cryogenic distillation of the air in a system of columns in which air is separated in a system of columns in order to produce a gas enriched in argon, the gas enriched in argon is sent to an argon separation column, a flow rich in argon is withdrawn at the top of the column and a liquid enriched in oxygen is withdrawn at the bottom of the column and returned to the system of columns, in which:

i) during a first operation, if, preferably only if, the load of the column is below a first threshold, liquid is withdrawn from the column at a first intermediate level of the column and stored in a first storage tank, no liquid being sent from the storage tank to the column, liquid is withdrawn from the column at a third intermediate level of the column and stored in a second storage tank, no liquid being sent from the storage tank to the column, ii) during a second operation, if, preferably only if, the load of the column is above a second threshold, greater than the first threshold, no liquid is sent from the column to the first storage tank, liquid is sent from the first storage tank to the column at a second intermediate level of the column separated from the first intermediate level by at least one layer of elements making possible the exchange of mass and of heat, the second intermediate level being located below the first intermediate level; during the second operation, no liquid is sent from the column to the second storage tank, liquid is sent from the second storage tank to the column at a fourth intermediate level of the column separated from the third intermediate level by at least one layer of elements making possible the exchange of mass and of heat, the fourth intermediate level being located below the third intermediate level and the third intermediate level not being located above the second intermediate level.

Preferably:

- no element making possible the exchange of mass and of heat is positioned between the second and third intermediate levels,
- flows from at least three different intermediate levels are stored each in a respective storage tank during the first operation and no liquid is sent from the storage tank to the column and, during the second operation, a liquid is sent from each of the at least three storage tanks at a level of the column lower than that at which the liquid was withdrawn from the column,
- the argon separation column comprises a top condenser fed with liquid via a liquid originating from the system of columns, the liquid vaporized in the top condenser being returned to the system of columns according to the two operations, and in which it is detected if the load threshold of the column is exceeded by measuring the flow rate of vaporized liquid sent to the system of columns.

According to another subject-matter of the invention, provision is made for a plant for the production of argon by cryogenic distillation of air in a system of columns for the implementation of the above process, comprising an argon separation column, means for sending a gas containing argon and oxygen to the column, means for extracting a fluid enriched in argon at the top of the column, means for extracting a liquid enriched in oxygen at the bottom of the column and at least two storage tanks, positioned one above the other, each storage tank being connected to two different intermediate levels of the argon separation column by two pipes, wherein the two storage tanks are contiguous.

Preferably:

- the at least two storage tanks are formed by two tanks in a common shell, preferably containing only storage tanks, the bottom of one storage tank preferably constituting the roof of the lower storage tank,
- the roof of a lower storage tank constitutes the bottom of an intermediate storage tank above the lower storage tank,
- the plant comprises supporting means for the at least two storage tanks directly connected to the ground,
- the plant does not comprise any means for pressurizing the liquid to be sent from the intermediate level of the column to the storage tank and any means for pressurizing the liquid to be sent from the storage tank to the column, the elevation of the storage tank being chosen as a function of the point of withdrawal and of the point of return of the liquid,
- the at least two storage tanks are connected to one another in order to form a structure positioned on the ground,
- the at least two, preferably at least four, storage tanks form an elongated body, the length of which is equal to at least half of the length of the argon separation column,
- at least one of the storage tanks and at least one pipe, indeed even both, connected to the storage tank are positioned so that the liquid passes from the column to the storage tank and/or vice versa, without using a pump,
- the plant does not comprise a pump for transporting liquid from the column to the storage tanks and/or from the storage tanks to the column,
- the storage tanks are positioned in a dedicated cold box,
- the storage tanks are positioned in a cold box with the argon separation column,
- the bottom liquid pump of the argon separation column is positioned directly below the lowest storage tank.

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

The FIGURE provides a flow diagram in accordance with an embodiment of the present invention.

DETAILED DESCRIPTION OF THE INVENTION

The FIGURE shows a plant for the production of argon by cryogenic distillation according to the invention.

In one embodiment, the plant comprises a system of columns for separating the cooled and purified air formed by a double column comprising a medium-pressure column and a low-pressure column which placed one above the other and thermally connected together. The low-pressure column produces a gas enriched in argon ORG comprising at least 10 mol % of argon. The gas ORG is sent to the bottom of an argon separation column K.

The argon separation column K comprises eight layers 1, 2, 3, 4, 5, 6, 7, 8 of mass and heat transfer elements, comprised by structured packings, but the number of layers can be greater or lower depending on the purity required. The column also comprises a top condenser C which receives liquid enriched in oxygen from the system of columns, more specifically from the bottom of the medium-pressure column. The liquid is vaporized therein and the vapour formed LRV is sent to the system of columns.

The bottom liquid ORL from the column K is pressurized by a pump P10 and sent to the system of columns through a valve V1.

Gaseous argon at the top of the column K is condensed in the condenser C. The condenser C receives a liquid enriched in oxygen originating from a medium-pressure column of a double air separation column forming part of the system of columns. This liquid enriched in oxygen, known as rich liquid, is vaporized at least partially in the condenser C to form a gas LRV.

The liquid argon produced is returned in part to the column K via the valve V3 and is extracted in part via the valve V2 as product ARG, when the column K is in operation.

Next to the column is found a structure S formed by at least two stacked storage tanks. In the FIGURE, six storage tanks S1, S2, S3, S4, S5, S6 are stacked, so that the bottom of an upper storage tank is the roof of the lower storage tank.

The storage tanks can nevertheless be independent of one another in order to be able to separate them and to use them in another plant.

However, it is preferable to construct a tower with a single shell containing a multiplicity of compartments, formed by partitions P. Each compartment acts as liquid storage tank.

This structure is positioned parallel with the column and is supported by supporting means M, independent of the column K, said means being fixed to the ground T.

When the load of the column K is above a first threshold and below a second threshold, no liquid flow is sent from the column K to the storage tanks S1, S2, S3, S4, S5, S6 and no liquid flow is sent from the storage tanks to the column K.

In a first operation, when the load of the column is below a first threshold, liquid is withdrawn at at least one intermediate level of the column K and sent to at least one of the storage tanks S1, S2, S3, S4, S5, S6. For example, liquid 9 can be sent from a level below the layer 8 and above the layer 7 via the valve V4 to the storage tank S6 and/or liquid 13 can be sent from a level below the layer 7 and above the layer 6 via the open valve V6 to the storage tank S5 and/or liquid 17 can be sent via the open valve V8 from below the layer 6 and above the layer 5 to the storage tank S4 and/or liquid 21 can be sent via the open valve V10 from below the layer 5 and above the layer 4 to the storage tank S3 and/or liquid 25 can be sent via the open valve V12 from below the layer 4 and above the layer 3 to the storage tank S2 and/or liquid 29 can be sent via the open valve V14 from below the layer 3 and above the layer 2 to the lower storage tank S1.

Obviously, the number of storage tanks can be less or greater than 6.

The fall in the load is detected by measuring the flow rate of vaporized liquid LRV sent from the condenser C to the system of columns. If this passes below the first threshold, the dispatch of liquid to at least one storage tank is triggered and is halted when the level required in the storage tank is reached.

In a second operation, if the load of the column is above a second threshold, greater than the first threshold, liquid is withdrawn from the storage tank S6 and send via the valve V5 to a level intermediate between the layers 7 and 6 and/or liquid is withdrawn from the storage tank S5 and send via the valve V7 to a level intermediate between the layers 6 and 5 and/or liquid is withdrawn from the storage tank S4 and sent via the valve V9 to a level intermediate between the layers 5 and 4 and/or liquid is withdrawn from the storage tank S3 and sent via the valve V11 to a level intermediate between the layers 4 and 3 and/or liquid is withdrawn from the storage tank S2 and send via the valve V13 to a level intermediate between the layers 3 and 2 and/or liquid is withdrawn from the storage tank S1 and sent via the valve V15 to an intermediate level between the layers 2 and 1.

During the first operation, no liquid is withdrawn from a storage tank to the column K and, during the second operation, no liquid is sent from the column to a storage tank.

When the load is reduced, during the second operation, the exchange surface area of the condenser C having to be reduced, liquid argon is stored in the condenser C itself for this purpose. This liquid will be taken from storage during the rise in load and will carry out the function of holding tank.

A small tank can optionally be added at the top of the column in order to compensate for the liquid reflux in deficit during the fall in load as a result of the excess of liquid stored in the condenser C with respect to the gas load.

For the other sections, storage tanks S1, S2, S3, S4, S5, S6 will be filled during the fall in load via the layer N by a level control, the set point of which will be a gradient as a function of the flow rate of vaporized liquid LRV and of a delay time. These same storage tanks will be emptied into the lower layer N−1' by a level control, the set point of which will be a gradient as a function of the flow rate of vaporized liquid LRV and of a delay time.

The bottom of the storage tank will be located at a level so that the liquid sent from the column K to the storage tank does not have to be pressurized in order to arrive at the storage tank. Likewise, the liquid from the storage tank flows out naturally to the column K.

The positioning of these storage tanks, which also includes a pressure-balancing line, will be carried out by adjusting them one above the other in order for their elevation to make good hydraulic functioning possible and does not require special supporting at the level of the column. The structure can be supported by a vertical conduit with intermediate bottoms resting on the ground T.

The storage tanks S1 to S6 are positioned in a dedicated cold box not containing a distillation column.

However, they can be positioned in a cold box with the argon separation column or another distillation column.

The bottom liquid pump P10 of the argon separation column K can be positioned directly below the lowest storage tank S1.

The invention claimed is:

1. A process for the production of argon by cryogenic distillation, the process comprising the steps of:

sending a gas enriched in argon that was produced by air separation in a system of columns to an argon separation column;

withdrawing a flow rich in argon at a top of the argon separation column; and withdrawing a liquid enriched in oxygen at a bottom of the argon separation column; returning the liquid enriched in oxygen to the system of columns;

determining, using a controller, whether a load of the argon separation column is below a first threshold;

determining, using the controller, whether the load of the argon separation column is above a second threshold, wherein the second threshold is greater than the first threshold;

whereupon a determination that the load of the argon separation column is below a first threshold, the process further comprises a first mode of operation, whereupon a determination that the load of the argon separation column is above a second threshold, the process further comprises a second mode of operation, whereupon a determination that the load of the argon separation column is between the first threshold and the second threshold, the process further comprises a third operation, i) wherein during the first mode of operation the process comprises the steps of:

withdrawing a first liquid from a first intermediate location of the argon separation column and storing the first liquid in a first storage tank;

preventing, using a first valve, the first liquid stored within the first storage tank from flowing to a second intermediate location of the argon separation column;

withdrawing a third liquid from the argon separation column at a third intermediate location of the argon separation column and storing the third liquid in a second storage tank;

preventing, using a second valve, the third liquid stored within the second storage tank from flowing to a fourth intermediate location of the argon separation column, ii) wherein during the second mode of operation, the process comprises the steps of:

preventing, using a third valve, the first liquid from the first intermediate location of the argon separation column from flowing to the first storage tank;

sending liquid argon from the first storage tank to the second intermediate location of the argon separation column, wherein the second intermediate location is separated from the first intermediate location by at least one layer of structured packing that is configured for the exchange of mass and of heat, the second intermediate location being located below the first intermediate location;

preventing, using a fourth valve, the third liquid from the third intermediate location of the argon separation column from flowing to the second storage tank; and sending the third liquid from the second storage tank to the argon separation column at a fourth intermediate location of the argon separation column, wherein the fourth intermediate location is separated from the third intermediate location by at least one layer of structured packing that is configured for the exchange of mass and of heat, the fourth intermediate location being located below the third intermediate location and the third intermediate location not being located above the second intermediate location.

2. The process according to claim 1, wherein no structured packing is positioned between the second and third intermediate locations.

3. The process according to claim 1, wherein the argon separation column comprises a top condenser, wherein the process further comprises:

feeding the top condenser with an oxygen rich liquid received from a lower portion of the system of columns; and sending a vaporized liquid from the top condenser to the system of columns.

4. The process according to claim 3, wherein the step of determining, using the controller, whether the load of the argon separation column is below the first threshold further comprises measuring a flow rate of the vaporized liquid sent from the condenser C to the system of columns.

5. The process according to claim 1, wherein during the third mode of operation, the process comprises the steps of:

preventing, using a fifth valve, flow of the first liquid from the first intermediate location of the argon separation column to the first storage tank, and preventing, using a sixth valve, a flow of the third liquid from the third intermediate location of the argon separation column to the second storage tank;

preventing, using the first valve, the first liquid stored within the first storage tank from flowing to the second intermediate location of the argon separation column from the first storage tank;

preventing, using the second valve, the third liquid stored within the second storage tank from flowing to the fourth intermediate location of the argon separation column.

6. A plant for the production of argon by cryogenic distillation of air in a system of columns for the implementation of a process according to claim 1, the plant comprising the argon separation column, a first pipe configured to send a gas containing argon and oxygen to the argon separation column, a second pipe configured to extract a fluid enriched in argon at a top of the argon separation column, a third pipe configured to extract a liquid enriched in oxygen at a bottom of the argon separation column and the first storage tank and the second storage tank, wherein the second storage tank is positioned above the first storage tank, and each of the first and second storage tank is connected to the second and fourth intermediate locations, respectively, by a fourth pipe and a fifth pipe, wherein the first and second storage tanks are contiguous.

7. The plant according to claim 6, in which the first and second storage tanks are formed by two tanks in a common shell.

8. The plant according to claim 6, comprising an absence of a pump or compressor configured to pressurize the liquid to be sent from the first intermediate location of the argon separation column to the first storage tank and an absence of a pump or compressor configured to pressurize the first liquid to be sent from the first storage tank to the second intermediate location of the argon separation column, the elevation of the first storage tank being chosen as a function of a point of withdrawal of the first liquid from the first intermediate location of the argon column and of a point of return to the second intermediate location of the argon separation column of the first liquid argon.

9. The plant according to claim 6, in which the first and second storage tanks are connected to one another in order to form a structure positioned on the ground.

10. The plant according to claim 6, in which the first and second storage tanks form an elongated body, a length of which is equal to at least half of a total length of the argon separation column.

11. The plant according to claim 6, in which at least one of the first and second storage tanks and at least one pipe of the two pipes, or both of the two pips, connected to the respective storage tank is/are positioned so that the liquid passes from the argon separation column to the storage tank and/or vice versa, without using a pump.

12. The plant according to claim 6, wherein a floor of the first storage tank is positioned at a height that is higher than the second intermediate location.

13. The plant according to claim 6, in which the first and second storage tanks are positioned in a dedicated cold box.

14. The plant according to claim 6, in which the first and second storage tanks are positioned in a cold box with the argon separation column.

15. The plant according to claim 6, in which a bottom liquid pump of the argon separation column is positioned below the lowest storage tank.

* * * * *